US010165376B2

(12) United States Patent
Vajha et al.

(10) Patent No.: US 10,165,376 B2
(45) Date of Patent: Dec. 25, 2018

(54) NON-CONTACT ANTENNA FEED

(71) Applicant: Starkey Laboratories, Inc., Eden Prairie, MN (US)

(72) Inventors: Sasidhar Vajha, Liague City, TX (US); Casey Edward Murray, Waconia, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 273 days.

(21) Appl. No.: 14/674,510

(22) Filed: Mar. 31, 2015

(65) Prior Publication Data

US 2016/0295335 A1 Oct. 6, 2016

(51) Int. Cl.

| | |
|---|---|
| ***H04R 25/00*** | (2006.01) |
| ***H01Q 1/27*** | (2006.01) |
| ***H01Q 7/00*** | (2006.01) |
| ***H01Q 9/04*** | (2006.01) |

(Continued)

(52) U.S. Cl.

CPC ..... *H04R 25/554* (2013.01); *H01Q 1/273* (2013.01); *H01Q 1/36* (2013.01); *H01Q 1/50* (2013.01); *H01Q 7/00* (2013.01); *H01Q 9/0457* (2013.01); *H04R 25/556* (2013.01); *H04R 25/65* (2013.01);

(Continued)

(58) Field of Classification Search

CPC .. H04R 25/552; H04R 25/554; H04R 25/556; H04R 25/558; H04R 25/608; H04R 25/65; H04R 25/658; H04R 2225/51; H04R 2420/07; H01Q 1/273; H01Q 1/36; H01Q 9/0457

USPC ..... 381/312, 314, 315, 322, 324, 328, 330, 381/331; 379/430, 443; 343/702, 718, 343/866; 455/107, 575.7

See application file for complete search history.

(56) References Cited

U.S. PATENT DOCUMENTS

| | | | | |
|---|---|---|---|---|
| 7,646,356 | B2 | 1/2010 | Adel et al. | |
| 7,791,551 | B2 * | 9/2010 | Platz | H01Q 1/085 343/718 |
| 2005/0048934 | A1 | 3/2005 | Rawnick et al. | |

(Continued)

FOREIGN PATENT DOCUMENTS

| | | | |
|---|---|---|---|
| EP | 2680366 | A1 | 1/2014 |

OTHER PUBLICATIONS

Vajha, Sasidhar, "A novel proximity coupled active integrated antenna", 31st European Microwave Conference, (2001), 1-4 pgs.

(Continued)

*Primary Examiner* — Huyen D Le

(74) *Attorney, Agent, or Firm* — Schwegman Lundberg & Woessner, P.A.

(57) ABSTRACT

The present disclosure relates to inclusion of a non-contact antenna. The non-contact antenna can allow a variety of antennas to be used on a hearing assistance device and can overcome issues associated with mounting an antenna internal to the case of a hearing assistance device. A non-contact antenna may include a proximity coupled antenna, such as an antenna mounted on a hearing assistance device case (external to the case) near a feed line that will transfer energy between the antenna and an SMD internal to the case. A non-contact antenna may include an aperture coupled antenna, such as an antenna mounted external to the case on an antenna substrate, where the antenna substrate is on a feed substrate with a feed line, and where there is an aperture in a ground plane.

13 Claims, 9 Drawing Sheets

(51) Int. Cl.
*H01Q 1/36* (2006.01)
*H01Q 1/50* (2006.01)

(52) U.S. Cl.
CPC ..... *H04R 25/658* (2013.01); *H04R 2225/51* (2013.01)

(56) References Cited

U.S. PATENT DOCUMENTS

| | | | | |
|---|---|---|---|---|
| 2011/0050510 | A1* | 3/2011 | Li | H01Q 7/08 343/702 |
| 2013/0234899 | A1 | 9/2013 | Pope et al. | |
| 2013/0342407 | A1 | 12/2013 | Kvist et al. | |
| 2013/0343586 | A1 | 12/2013 | Kvist et al. | |

OTHER PUBLICATIONS

Vajha, Sasidhar, "Design and Modeling of Proximity Coupled Patch Antenna", IEEE-APS Conference on Antennas and Propagation for Wireless Communications, (2000), 43-46.

"European Application Serial No. 16163456.3, Extended European Search Report dated Oct. 8, 2016", 8 pgs.

"European Application Patent No. 16163456.3, Response filed Apr. 5, 2017 to Extended European Search Report dated Oct. 8, 2016", 15 pgs.

Balakrishnan, T, et al., "A Wide Band Proximity Coupled Antenna with Slot in the Microstrip Feed and the Ground Plane", IEEE 1-4244-0549-1.06, (2006), 4 pgs.

Osman, Lotfi, et al., "Proximity Coupled Microstrip Patch Antenna Design with Reduced Out of Band Harmonics Device at 2.45 GHz", University of Tunis El Manar, 3 pgs.

Ramirez, Raul R, et al., "Single Feed Proximity Coupled Circularly Polarized Microstrip Monofilar Archimedean Spiral Antenna Array", IEEE Transactions on Antennas and Propagation vol. 47 No. 2, (Feb. 1999), 406-407.

Rowe, W.S.T., et al., "Investigation of Proximity Coupled Antenna Structures", IEEE 0-7803-7846-6/03, 904-907.

Sun, Dan, et al., "A Broadband Impedance Matching Method for Proximity-Coupled Antenna", IEEE Transactions on Antennas and Propagation vol. 58 No. 4, (Apr. 2010), 1392-1397.

* cited by examiner

NON-CONTACT ANTENNA FEED

FIELD OF THE INVENTION

This patent application pertains to apparatuses and processes for a non-contact antenna feed in hearing assistance devices.

BACKGROUND

Current hearing assistance devices use a flex antenna mounted to a connection pad inside a hearing device case. The flex antenna is soldered to a circuit board internal to the hearing device case. A solder connection can fail and cause a short or can be defective and reduce the radiated power of the antenna. Another problem associated with such a design is that a signal radiated from the antenna is attenuated by the case of the hearing assistance device.

What is needed in the art is an improved antenna mount in a hearing assistance device that can increase the antenna radiated power and/or include a more reliable electrical connection.

SUMMARY

Disclosed herein, among other things, are hearing assistance devices and methods of making or using the same. Hearing assistance devices include, but are not limited to, hearing aids. One or more embodiments are hearing assistant devices with a non-contact antenna configuration. A non-contact antenna configuration includes an antenna that is physically separated from a feed line by a dielectric material, where the dielectric material enables the feed line to remain electrically coupled to the antenna such that energy on the feed line can be transferred to the antenna and energy received at the antenna can be transferred to the feed line.

This application proposes the inclusion of a non-contact antenna. The non-contact antenna can allow a variety of antennas to be used on a hearing assistance device and can overcome issues associated with mounting an antenna internal to the case of a hearing assistance device. For example, misalignment of antenna pads and surface mount device (SMD) pads can be avoided by using a non-contact antenna in a hearing assistance device.

In current applications, the antenna of the hearing assistance device is soldered to SMD pads internal to the device. Because the antenna is mounted internal to the case, the power radiated from the antenna to an object external to the case is reduced. In addition, soldering the antenna to internal SMD pads restricts the antenna technology employed in the hearing assistance device and creates opportunities for manufacturing defects in the devices. For example, solder voids can be present in the antenna and SMD pad connection, thus reducing electrical connectivity and attenuating a signal from the antenna. In another example of a manufacturing defect, the antenna pads can be misaligned with respect to the SMD pads, thus reducing electrical connectivity and attenuating a signal from the antenna.

There are a variety of opportunities for implementation. Some such implementations include a proximity coupled antenna. In these implementations, an antenna can be mounted on a hearing assistance device case (external to the case) near a feed line that will transfer energy between the antenna and an SMD internal to the case. In other implementations, an antenna can be aperture coupled. In aperture coupled implementations, an antenna can be mounted external to the case on an antenna substrate, where the antenna substrate is on a feed substrate with a feed line, and where there is an aperture in the feed substrate. In aperture coupled implementations, the antenna substrate couples antenna radiation to the feed substrate, where the coupling is accomplished using the aperture and the materials of the antenna and feed substrates. The feed line converts the coupling to an electrical signal and routes the signal to the SMD internal to the case of the hearing assistance device.

This Summary is an overview of some of the teachings of the present application and not intended to be an exclusive or exhaustive treatment of the present subject matter. Further details about the present subject matter are found in the detailed description and appended claims. The scope of the present application is defined by the appended claims and their legal equivalents.

DETAILED DESCRIPTION

Disclosed herein, among other things, are methods and apparatuses for non-contact antennas in hearing assistance devices.

Figure 1:
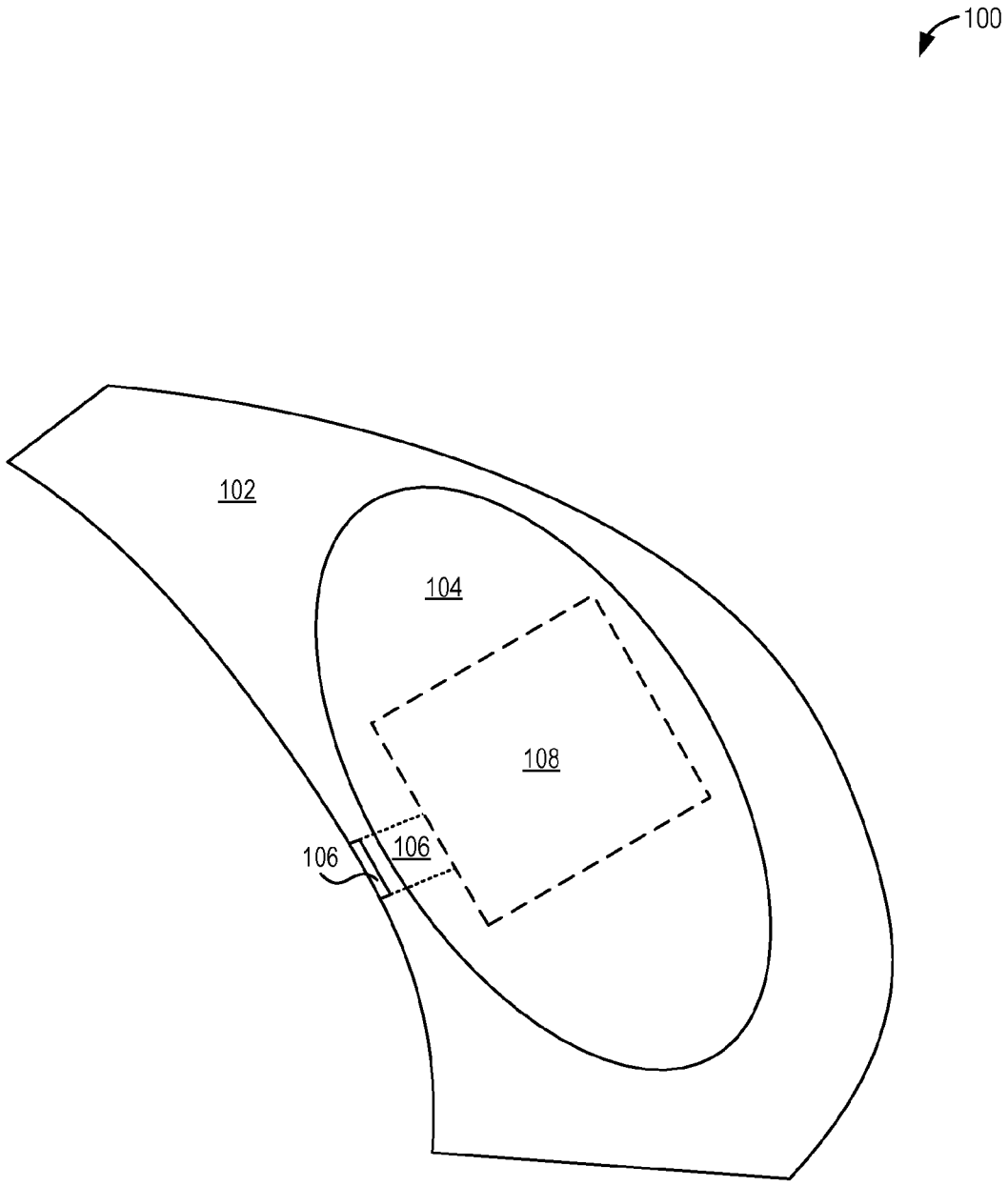
FIG. 1 shows a non-contact antenna feed for a behind-the-ear (BTE) local hearing assistance device.

FIG. 1 illustrates, by way of example, a non-contact antenna feed design for a behind-the-ear (BTE) (e.g., a typical BTE or a mini BTE, sometimes also called an "on-the-ear") local hearing assistance device 100. The device 100 as illustrated includes a housing 102 and an antenna 104 mounted on the exterior of the housing 102. The device 100 as illustrated also includes a feed line 106 situated partially in the housing 102 and partially out of the housing 102. The feed line 106 is electrically connected to the processing circuitry 108 and electrically coupled to the antenna 104.

The housing 102 can include one or more layers of polymer or other deformable material built around the processing circuitry 108. The housing can be configured to conform to a surface in contact with the housing, such as an ear, head, or other surface. The housing 102 can be configured to fit comfortably behind an ear of a person. The housing 102 can protect components of the processing circuitry 108 from an environment external to the housing 102, such as to help keep the processing circuitry dry.

The antenna 104 can be a variety of antenna types, such as a loop, patch, spiral, slot, or other antenna type. The antenna may be manufactured using various antenna manufacturing techniques, such as using Laser Direct Structuring (LDS) to create a molded interconnect antenna. The antenna 104 can be mounted on and external to the housing 102. Such mounting can help in retaining radiated power from the antenna 102 without attenuating the power through the housing 102. Such a configuration can have a higher radiated power from the antenna 104 as compared to a configuration that includes the antenna 104 internal to the housing 102.

Various antenna types may be used in non-contact antenna, such as a loop antenna, a spiral antenna, a patch antenna, a slot antenna, or other antenna type. A loop antenna may be constructed by forming an elongated piece of conductive material into a perimeter that defines an area. Loop antennas are generally thin pieces of conductive material arranged in an elliptical or rectangular shape. Loop antennas may sometimes be irregular in shape. A broken loop antenna is a loop antenna that includes a break or opening in the loop. A spiral antenna includes one or more arms that wind in a gradually widening radius from a central point. Spiral antennas are frequency independent antennas, which have nearly uniform impedance characteristics over a range of frequencies. A patch antenna, sometimes called a rectangular microstrip antenna, is an antenna that consists of a rectangular sheet of conductive material. Patch antennas are typically mounted over a ground plane with a dielectric (e.g., air, nitrogen, glass, plastic, or other dielectric material) therebetween. A slot antenna includes a sheet of conductive material with a hole in the sheet defining the antenna. A radiation pattern of the slot antenna is determined by various antenna design features, such as the shape and size of the slot and the driving frequency used to radiate the antenna.

Antennas may be formed using various manufacturing processes. An LDS antenna is an antenna formed using an LDS process. An LDS process includes using a thermopolymer as a substrate material and a metal-polymer additive activated by a light source. Locations where the thermopolymer material is radiated by the light source define a pattern for metallization on the material. When exposed to a conductive material bath, the conductive material forms a track on the material where the material was radiated by the light source. Layers, of copper, nickel, gold, or other conductors, can be formed using such a process.

The feed line 106 can be a variety of shapes and sizes. The feed line 106 can be configured to have a specific impedance characteristic. The feed line 106 can be positioned in proximity to the antenna 104, such as to be electrically coupled to the antenna 104. The coupling between the antenna 104 and the feed line 106 can be a proximity coupling or an aperture coupling.

In a proximity coupling, the distance between the antenna 104 and the feed line 106 needs to be controlled so that sufficient energy can be transferred from the antenna 104 to the feed line 106, and vice versa. In a proximity coupling, the antenna 104 can be separated from the feed line by a dielectric material with a specified dielectric constant (e.g., relative permittivity) and a specific distance. The dielectric material can be a solid dielectric (e.g., glass, plastic), a liquid dielectric (e.g., mineral oil, glycerol), or a gas-filled gap (e.g., a gap filled with air or nitrogen). In some examples, the combination of a conductive antenna 104, and a dielectric material, and a conductive feed line 106 may be used to form a metal-insulator-metal (MIM) capacitor. The MIM capacitor may be used to reduce or eliminate antenna tuning elements on a surface-mounted device (SMD).

In an aperture coupling, an aperture is situated between the antenna 104 and the feed line 106, such that radiation of the antenna 104 causes the aperture to radiate and transfer energy to the feed line 106. See FIG. 6 and FIG. 7 for an example of an antenna 104 and feed line 106 with an aperture coupling.

The feed line 106 can include a first portion (a portion internal to the housing 102 as indicated by the dashed line labelled "106") and a second portion (a portion external to the housing as indicated by the solid line labelled "106").

The processing circuitry 108 can include hearing assistance device processing components and provide the functionality of a hearing assistance device. The processing circuitry can include a microphone to receive sound waves incident thereon and convert the sound waves into audio signals. The signals from the microphone can be amplified and/or processed into a second signal that compensates for a hearing impairment. Processing the audio signal can include noise reduction, filtering, compressing, or other signal processing. This second signal can be provided to a speaker that converts the second signal into a sound wave that is provided to the entity using the hearing assistance device. The processing circuitry can include a transceiver electrically coupled with the antenna 104, such that signals can be transmitted from the antenna 104 to another device, such as another hearing assistance device, a programming device capable of programming one or more components of the processing circuitry, or other device.

Figure 2:
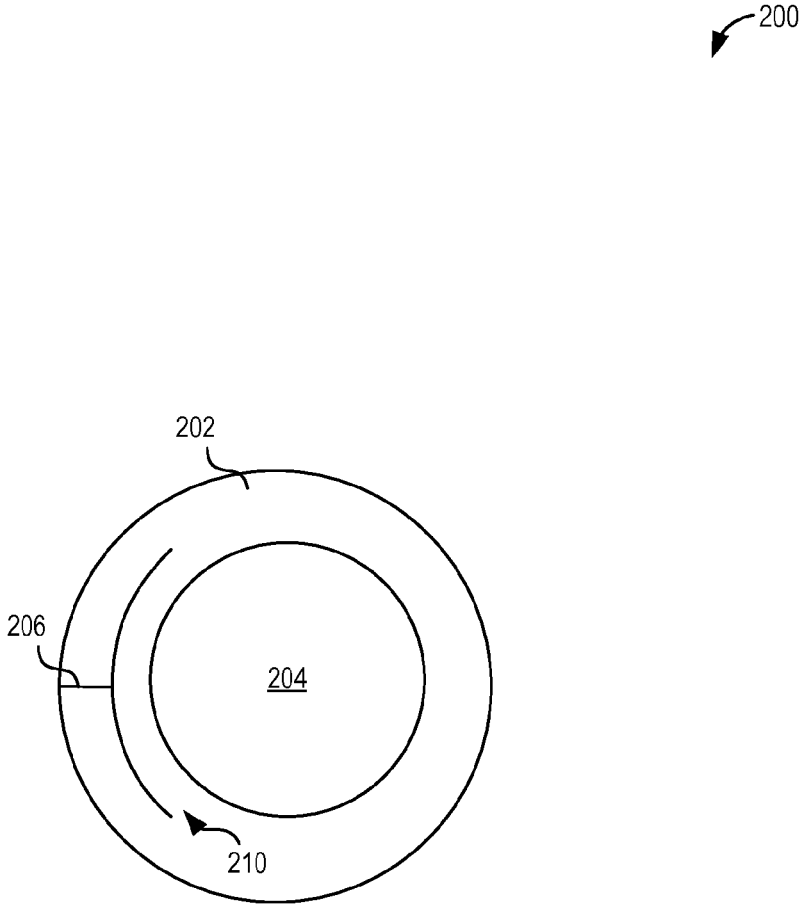
FIG. 2 illustrates a diagram of a loop antenna including a proximity coupling to a Y-shaped feed line.

FIG. 2 illustrates, by way of example, a diagram of an in the ear (ITE) type hearing assistance device 200 with a loop antenna 204 external to a housing 202 of the hearing assistance device 200. The loop antenna 204 is proximity coupled to a Y-shaped feed line 206. The feed line 206 can be situated in proximity to the antenna 204 with the Y-shaped portion of the feed line 206 external to the housing and a trace portion of the feed line internal to the housing 202.

The antenna 204 and the feed line 106 can be separated by a dielectric material 210. The dielectric material 210 can be a dielectric air gap or can include another dielectric material with a specific dielectric constant. Energy radiated on the antenna can be transferred to the feed line 206 without the need for a solder joint or other electrical connection on the antenna 204. The portion of the feed line 206 opposite the dielectric material 210 can be connected to the processing circuitry 208.

Figure 3:
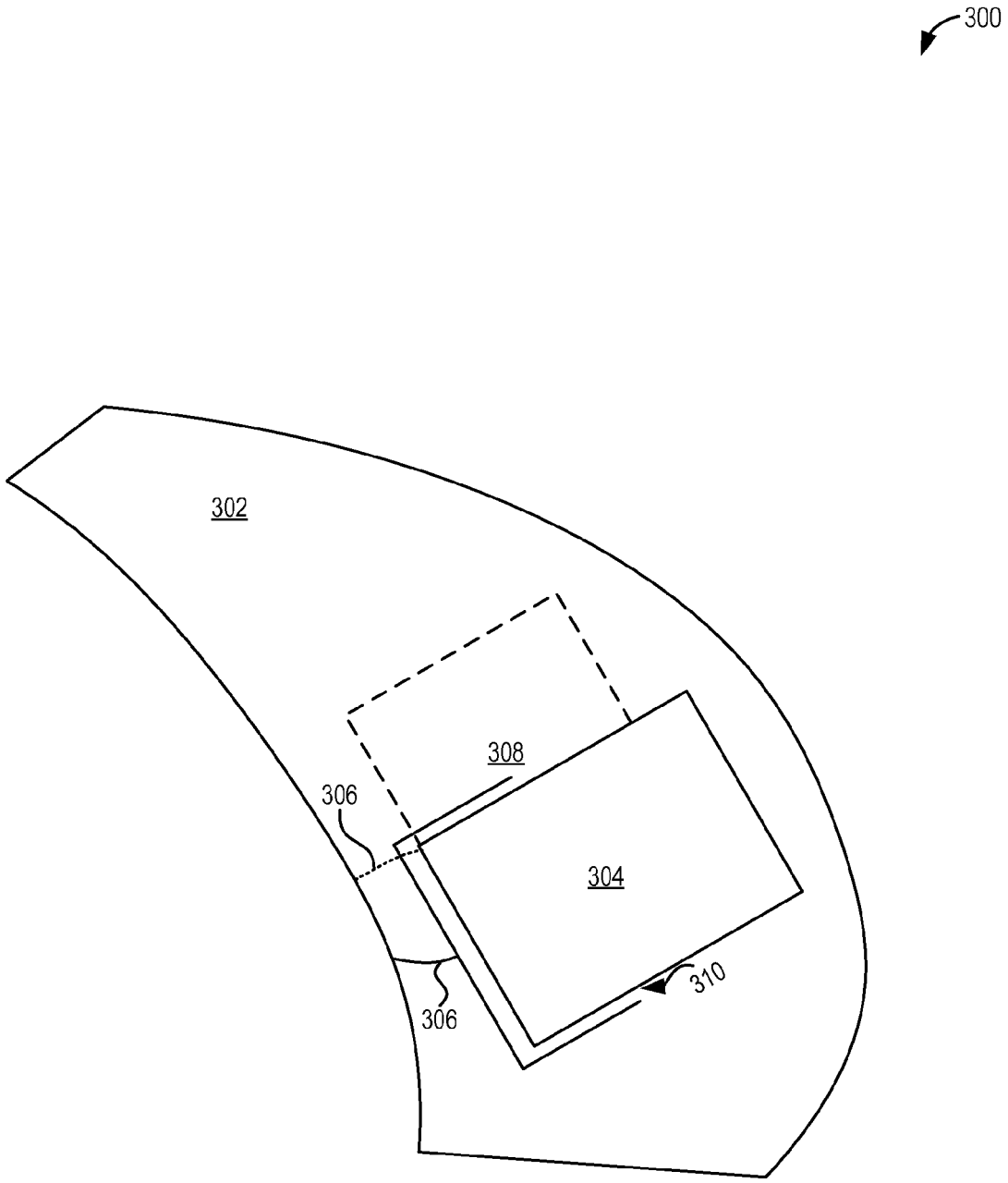
FIG. 3 illustrates a diagram of another loop antenna including a proximity coupling to another Y-shaped feed line.

FIG. 3 illustrates, by way of example, a diagram of a BTE type hearing assistance device 300 with a loop antenna 304 external to a housing 302 of the hearing assistance device 300. The loop antenna 304 can be situated on the exterior of the housing 302. The feed line 306 can be situated in proximity to the antenna 304 with the Y-shaped portion of the feed line 306 external to the housing.

As in FIG. 2, the antenna 304 and the feed line 306 in FIG. 3 can be separated by a dielectric material 310, where the dielectric material 310 can be a dielectric air gap or can include another dielectric material with a specific dielectric constant. Energy radiated on the antenna 304 can be transferred to the feed line 306 without an electrical connection, and the portion of the feed line 306 opposite the dielectric material 310 can be connected to the processing circuitry 308.

Figure 4:
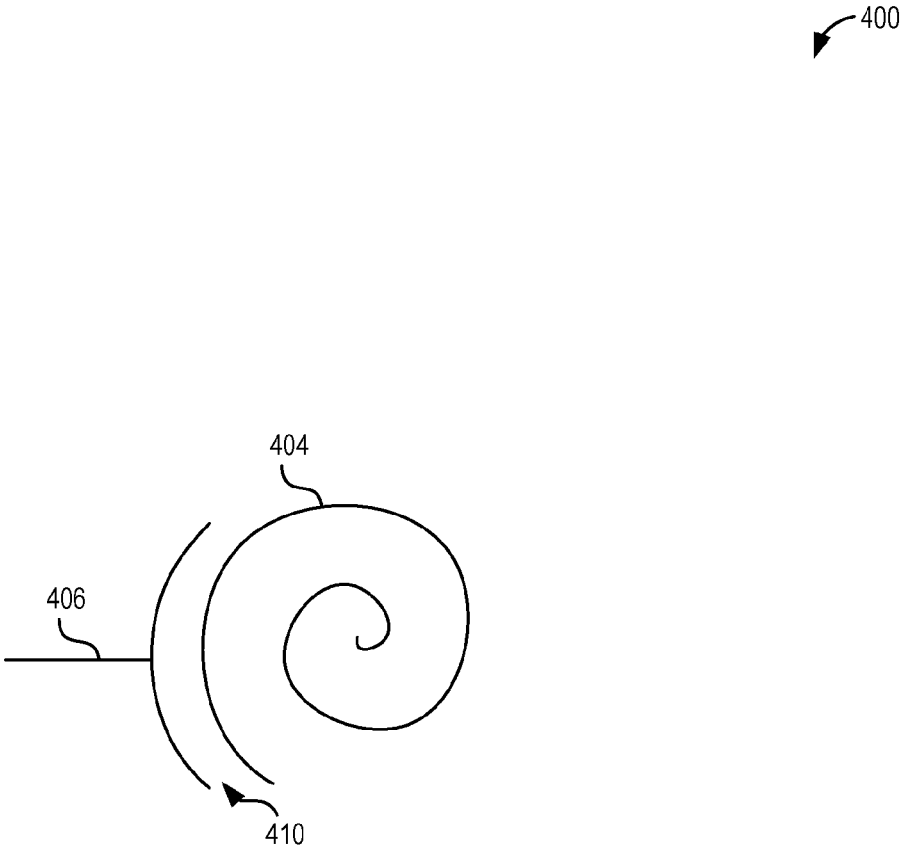
FIG. 4 illustrates a diagram of a spiral antenna including a proximity coupling to a Y-shaped feed line.

FIG. 4 illustrates a diagram of another embodiment of a proximity coupling 400 between a loop antenna 404 and Y-shaped feed line 406. The loop antenna 404 can be situated on the exterior of a housing of a hearing assistance device. The feed line 406 can be situated in proximity to the antenna 404 with the Y-shaped portion of the feed line 406 external to the housing. As in FIG. 2 and FIG. 3, the antenna 404 and the feed line 406 in FIG. 4 can be separated by a dielectric material 410, where the dielectric material 410 can be a dielectric air gap or can include another dielectric material with a specific dielectric constant. Energy radiated on the antenna can be transferred to the feed line 406 without an electrical connection, and the portion of the feed line 406 opposite the dielectric material 410 can be connected to the processing circuitry 108.

Figure 5:
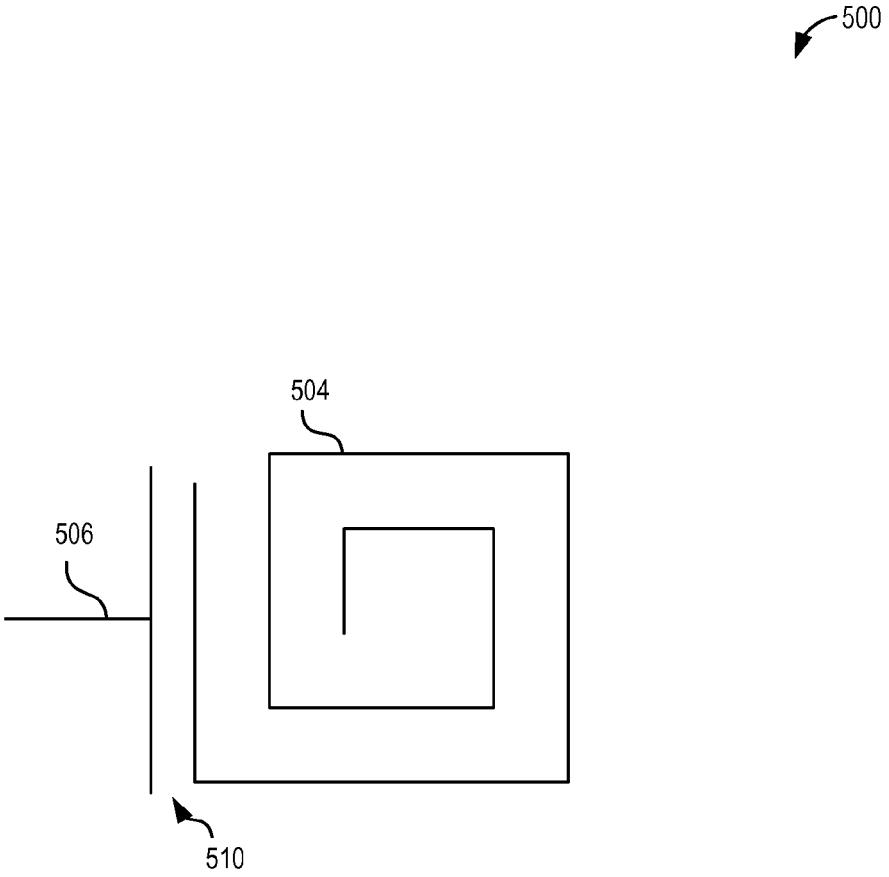
FIG. 5 illustrates a diagram of another spiral antenna including a proximity coupling to a T-shaped feed line.

FIG. 5 illustrates a diagram of a proximity coupling 500 between a loop antenna 504 and T-shaped feed line 506. The loop antenna 504 can be situated on the exterior of a housing of a hearing assistance device. The feed line 506 can be situated in proximity to the antenna 504 with the Y-shaped portion of the feed line 506 external to the housing. As in FIG. 2, FIG. 3, and FIG. 4, the antenna 504 and the feed line 506 in FIG. 5 can be separated by a dielectric material 510, where the dielectric material 510 can be a dielectric air gap or can include another dielectric material with a specific dielectric constant. Energy radiated on the antenna can be transferred to the feed line 506 without an electrical connection, and the portion of the feed line 506 opposite the dielectric material 510 can be connected to the processing circuitry 108.

Figure 6:
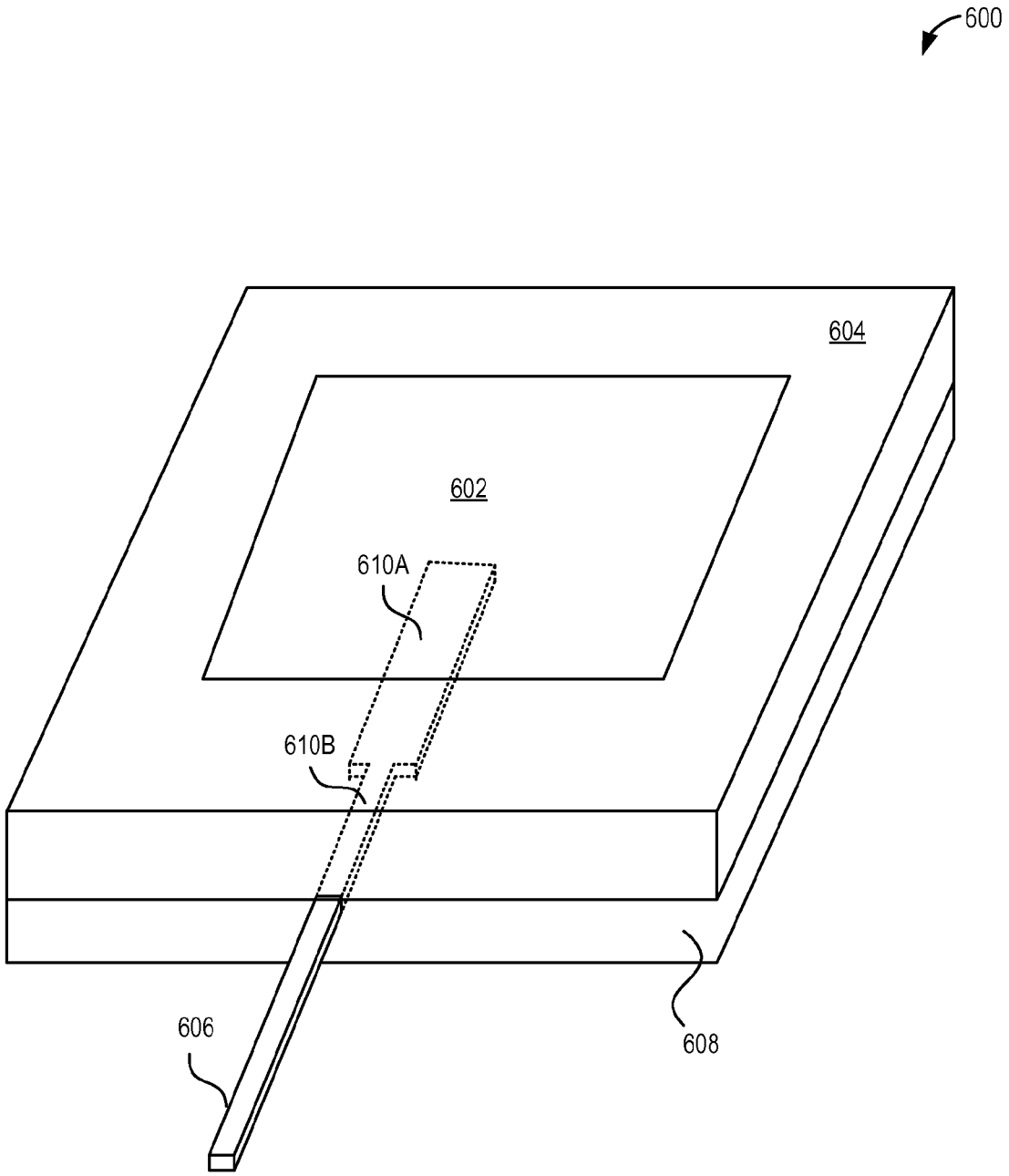
FIG. 6 illustrates a perspective view of a non-contact patch antenna feed design with a proximity coupling.

FIG. 6 illustrates a perspective view of a non-contact, proximity coupled, patch antenna 600. A patch antenna 600 includes a sheet of conductive material 602 defining the antenna. The conductive material 602 may be affixed to a first dielectric substrate 604. A feed line 606 can be situated in proximity to the conductive material 602. The feed line 606 shown in FIG. 6 has a rectangular cross-section, though a feed line may have other cross-sectional shapes or may consist of a narrow sheet of conductive material. The feed line 606 may be within the dielectric substrate 608 or on the surface of the dielectric substrate 608. Additional dielectric substrates may be used, where the additional dielectric substrates may have varying dielectric constants. In some embodiments, additional dielectric substrates may be separated by additional layers of conductive materials, by ground planes, or by other materials. The thickness of the substrate 604 can be controlled so that energy is transferred between the feed line 606 and the antenna 602. The antenna 602, substrate 604, and feed line 606 can form a MIM capacitor that helps in matching an impedance of the antenna 602 to an impedance of the feed line 606. The dimensions of the patch antenna (e.g., length and width), dielectric constant and thickness of the dielectric substrate 604, dielectric constant and thickness of the dielectric substrate 608, the feed line width and position relative to the conductive material 602 all affect the operation of the antenna 700.

The feed line 606 can include a first portion 610A within a footprint of the conductive material 602 that acts as the antenna. The feed line 606 can include a second portion 610B outside of the footprint of the conductive material 602. The first portion 610A can provide a more reliable electromagnetic coupling between the feed line 606 and the conductive material 602.

Figure 7:
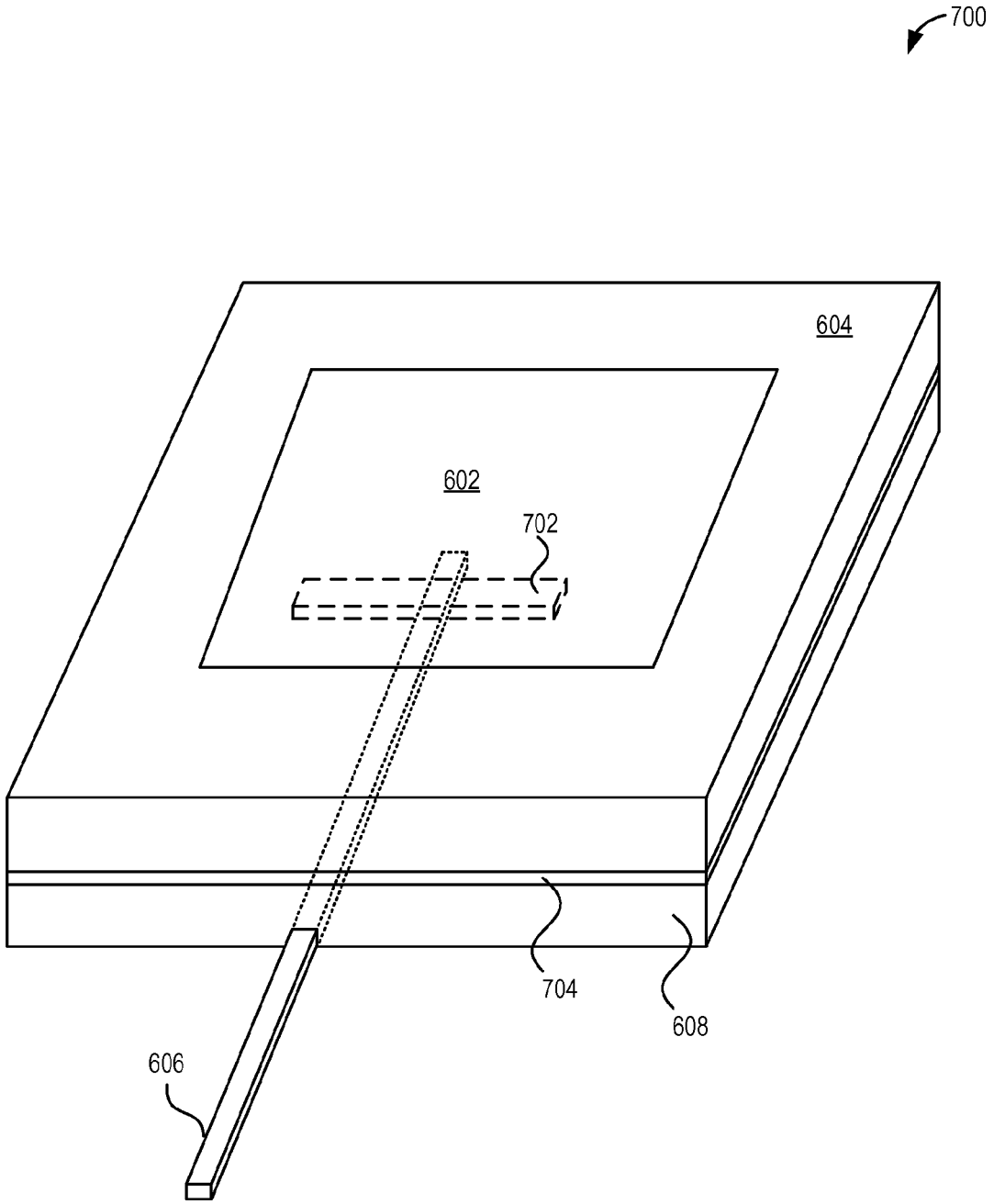
FIG. 7 illustrates a perspective view of a non-contact patch antenna with an aperture coupling.

FIG. 7 illustrates a perspective view of a non-contact, aperture coupled, patch antenna 700. The antenna 700 of FIG. 7 is similar to the antenna 600 with the antenna 700 including an aperture 702 in a ground plane 704 that is on the feed line substrate 608. The aperture 702 is situated between the antenna 602 and the feed line 606. The conductive material 602 may be affixed to a first dielectric substrate 604 (e.g., the antenna substrate). The feed line 606 can be situated in proximity to the conductive material 602 and to the aperture 702. The aperture 702 can resonate in response to radiating of the conductive material 602. The conductive material 602 is electromagnetically coupled to the feed line 606 through the aperture 702. The dimensions of the aperture 702 (e.g., length, width, offset), the patch antenna (e.g., length and width), dielectric constant and thickness of the dielectric substrate 604, dielectric constant and thickness of the dielectric substrate 608, the feed line width and position relative to the aperture 702, and the position of the conductive material 602 relative to the aperture 702 all affect the operation of the antenna 700.

The antennas 600 and 700 of FIGS. 6 and 7 can be situated on or at least partially in a housing of a hearing assistance device. The antenna 600 and 700 can be exterior to the housing while the feed line is either completely interior to the housing or the feed line is partially interior to the housing and partially exterior to the housing.

Figure 8:
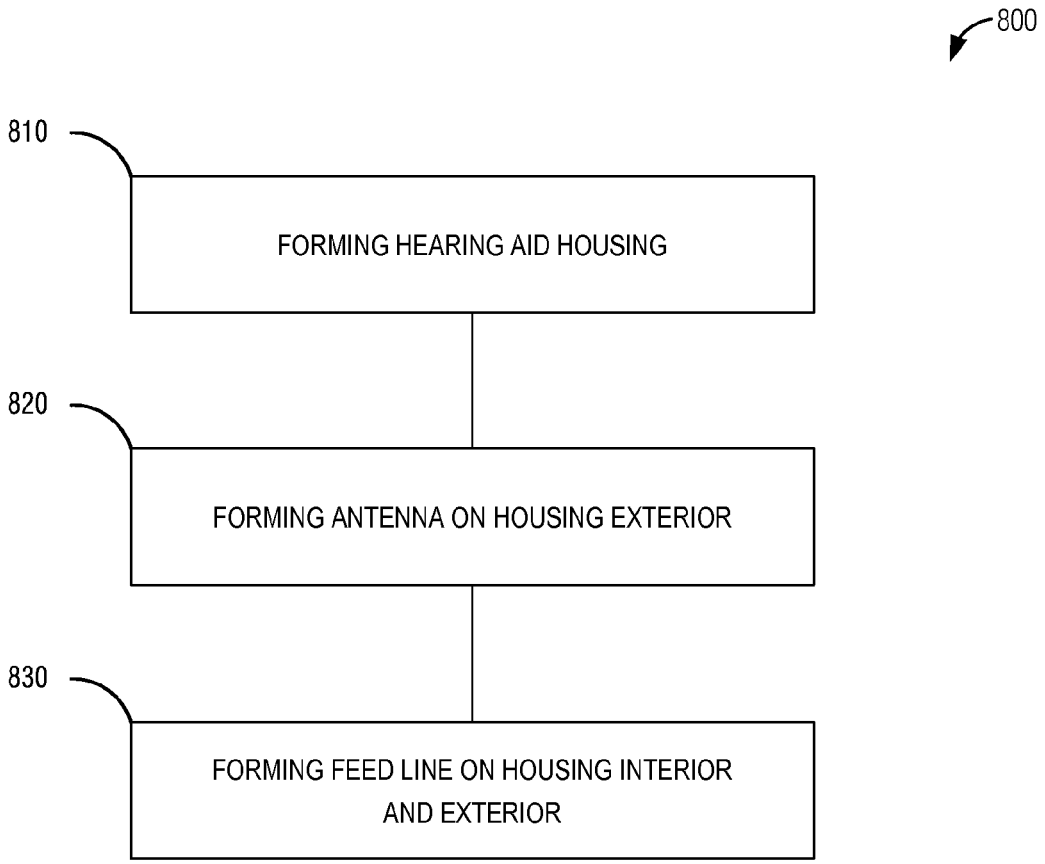
FIG. 8 illustrates a method of making a hearing assistance device with a non-contact antenna.

FIG. 8 illustrates a method 800 of forming a hearing assistance device. The method 800 as illustrated includes: forming a hearing aid housing, at operation 810; forming an antenna on an exterior side of the housing, at operation 820; and forming a feed line on the housing, at operation 830. The housing can be any housing discussed herein. The material that the housing is formed from can include a selected dielectric constant. The operation at 830 can include depositing a first portion of the feed line on an interior side of the housing. The operation at 830 can include depositing a second portion of the feed line on the exterior side of the housing. The second portion of the feed line can be deposited in proximity with the antenna so as to be separated from and electromagnetically coupled with the antenna.

Forming the antenna or the feed line can include using an LDS process to from the antenna of the feed line. The antenna can be any of a variety of antennas including a spiral or loop antenna. Forming the antenna and depositing the feed line can include situating the antenna and feed line to be separated by a dielectric material so as to form a metal-insulator-metal (MIM) capacitor using the feed line, antenna, and the dielectric material, the MIM capacitor to help match an impedance of the feed line to an impedance of the antenna.

Figure 9:
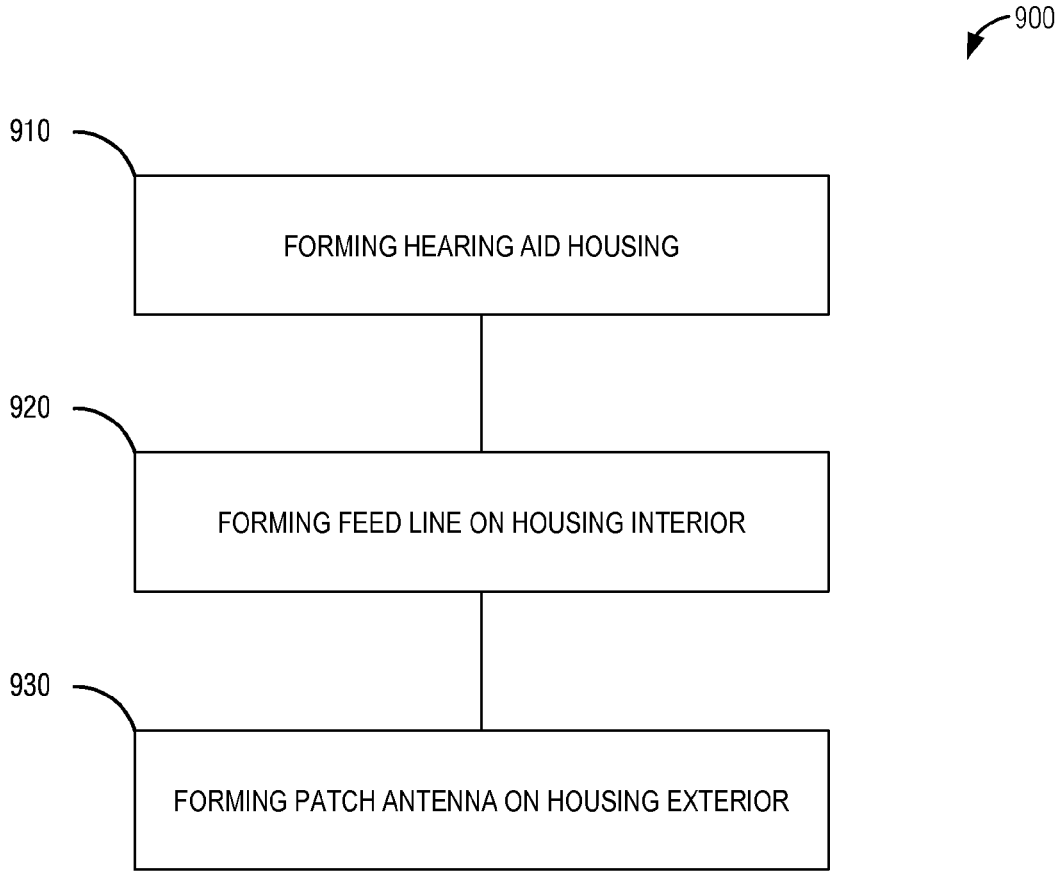
FIG. 9 illustrates another method of making a hearing assistance device with a non-contact antenna.

FIG. 9 illustrates a method 900 of forming a hearing assistance device. The method 900 as illustrated includes: forming a hearing aid housing, at operation 910; forming a feed line interior to the housing, at operation 920; and forming a patch antenna on an exterior side of the housing, at operation 930. The housing can be any of the housings discussed herein. The material that the housing is formed from can include a selected dielectric constant. The feed line can be formed in proximity to the antenna so as to be electromagnetically coupled to the patch antenna.

The operation at 920 can include depositing a first substrate (e.g., a feed substrate. The operation at 920 can include forming the feed line on or at least partially in the first substrate. The operation at 920 can include forming a first, wider portion of the feed line within a footprint of the patch antenna and forming a second, narrower portion of the feed line outside the footprint.

The operation at 930 can include depositing a second substrate on the first substrate. The operation at 930 can include situating conductive material on or at least partially in the second substrate. The operation at 930 can include situating a ground plane between the first substrate and the second substrate, the ground plane including an aperture therein. Forming the feed line, patch antenna, and the first substrate include forming a metal-insulator-metal (MIM) capacitor using the feed line, first substrate, and the patch antenna the MIM capacitor to help match an impedance of the feed line to an impedance of the antenna.

It is understood that in various embodiments, the apparatus and processes set forth herein may be embodied in digital hardware, analog hardware, and/or combinations thereof. It is also understood that in various embodiments, the apparatus and processes set forth herein may be embodied in hardware, software, firmware, and/or combinations thereof.

The present subject matter is demonstrated for hearing assistance devices, including hearing aids, including but not limited to, behind-the-ear (BTE), receiver-in-canal (RIC), and completely-in-the-canal (CIC) type hearing aids. It is understood that BTE type hearing aids may include devices that reside substantially behind the ear or over the ear. Such devices may include hearing aids with receivers associated with the electronics portion of the BTE device, or hearing aids of the type having receivers in the ear canal of the user, including but not limited to RIC or receiver-in-the-ear (RITE) designs. The present subject matter can also be used with in-the-ear (ITE) and in-the-canal (ITC) devices. The present subject matter can also be used with wired or wireless ear bud devices. The present subject matter can also be used in hearing assistance devices generally, such as cochlear implant-type hearing devices and such as deep insertion devices having a transducer, such as a receiver or microphone, whether custom fitted, standard, open fitted, or occlusive fitted. It is understood that other hearing assistance devices not expressly stated herein may be used in conjunction with the present subject matter.

The present subject matter can be described by way of several Examples.

Example 1 includes a hearing assistance device comprising a housing including processing circuitry therein, a feed line electrically connected to the processing circuitry, the feed line including a first portion internal to the case and second portion external to the case, a dielectric material, and an antenna mounted on an exterior of the case in proximity to the second portion of the feed line so as to be separated from the feed line by the dielectric material and electromagnetically coupled with the feed line.

Example 2 includes the device of example 1, wherein the antenna is a solid loop antenna.

Example 3 includes the device of any of examples 1-2, wherein the second portion of the feed line includes a Y-shape opening towards the antenna.

Example 4 includes the device of example 1, wherein the antenna is a Laser Direct Structuring (LDS) antenna including successive layers of conductive material formed on the case.

Example 5 includes the device of example 1, wherein the antenna is a spiral antenna.

Example 6 includes the device of any of examples 1-5, wherein the second portion of the feed line includes a Y-shape opening towards the antenna.

Example 7 includes the device of example 1, wherein the antenna, dielectric material, and feed line form a metal-insulator-metal (MIM) capacitor configured to help match an impedance of the antenna to an impedance of the feed line.

Example 8 includes the device of example 1, wherein the coupling between the antenna and the feed line is a proximity coupling.

Example 9 includes a hearing assistance device comprising a housing including processing circuitry therein, a feed line interior to the housing and electrically connected to the processing circuitry, and a patch antenna mounted on an exterior of the housing so as to be electromagnetically coupled with the feed line without being in direct contact with the feed line.

Example 10 includes the device of example 9, wherein the hearing assistance device includes an aperture between the feed line and the antenna, the aperture configured to electromagnetically couple the patch antenna to the feed line.

Example 11 includes the device of any of examples 9-10, wherein a length of the aperture is generally orthogonal to a length of the feed line.

Example 12 includes the device of any of examples 9-11, wherein the patch antenna is on or at least partially in an antenna substrate and the feed line is on or at least partially in a feed substrate and the feed substrate and the antenna substrate are separated by a ground plane.

Example 13 includes the device of any of examples 9-14, wherein the aperture is a void in the ground plane.

Example 14 includes the device of any of examples 9-11, wherein the patch antenna is proximity coupled to the feed line.

Example 15 includes the device of any of examples 9-14, wherein the feed line includes a first portion within a footprint of the patch antenna that is wider than a second portion of the feed line outside the footprint.

Example 16 includes the device of any of examples 9-12, wherein the feed line, the patch antenna, and a material between the feed line and the patch antenna form a metal-insulator-metal (MIM) capacitor configured to help match an impedance of the patch antenna to an impedance of the feed line.

Example 17 includes a method of forming a non-contact antenna feed for a hearing assistance device, the method comprising forming a hearing aid housing, the housing having a selected dielectric constant, forming an antenna on an exterior side of the housing, forming a feed line on the housing, a first portion of the feed line is deposited on an interior side of the housing and a second portion of the feed line is deposited on the exterior side of the housing, and the second portion of the feed line is in proximity with the antenna so as to be separated from and electromagnetically coupled with the antenna.

Example 18 includes the method of example 17, wherein forming the feed line includes depositing the feed line using Laser Direct Structuring (LDS).

Example 19 includes the method of example 17, wherein the antenna is a spiral antenna.

Example 20 includes the method of example 17, wherein the antenna is a solid loop antenna.

Example 21 includes the method of example 17, wherein forming the antenna and depositing the feed line include situating the antenna and feed line to be separated by a dielectric material so as to form a metal-insulator-metal (MIM) capacitor using the feed line, antenna, and the dielectric material, the MIM capacitor to help match an impedance of the feed line to an impedance of the antenna.

Example 22 includes a method of forming a non-contact antenna feed for a hearing assistance device, the method comprising forming a hearing aid housing, the housing having a selected dielectric constant, forming a feed line in an interior of the housing, forming a patch antenna on an exterior side of the housing so as to be separated from and electromagnetically coupled with the feed line.

Example 23 includes the method of example 22, wherein forming the feed line includes depositing the feed line using Laser Direct Structuring (LDS).

Example 24 includes the method of example 22, wherein forming the patch antenna includes depositing a first substrate, forming the feed line includes forming the feed line on or at least partially in the first substrate, forming the patch antenna includes depositing a second substrate on the first substrate, and forming the patch antenna includes situating conductive material on or at least partially in the second substrate.

Example 25 includes the method of any of examples 22-24, wherein forming the feed line further comprises forming a first, wider portion of the feed line within a footprint of the patch antenna and forming a second, narrower portion of the feed line outside the footprint.

Example 26 includes the method of any of examples 22-24, wherein forming the feed line further comprises situating a ground plane between the first substrate and the second substrate, the ground plane including an aperture therein.

Example 27 includes the method of any of examples 22-24, wherein forming the feed line, patch antenna, and the first substrate include forming a metal-insulator-metal (MIM) capacitor using the feed line, first substrate, and the patch antenna the MIM capacitor to help match an impedance of the feed line to an impedance of the antenna.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The preceding detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

What is claimed is:

1. A hearing assistance device comprising:

a housing including processing circuitry therein;

a feed line electrically connected to the processing circuitry, the feed line including a first portion internal to the housing and second portion external to the housing;

a dielectric material; and an antenna mounted on an exterior of the housing in proximity to the second portion of the feed line so as to be separated from the feed line by the dielectric material and electromagnetically coupled with the second portion of the feed line.

2. The device of claim 1, wherein the antenna is a solid loop antenna.

3. The device of claim 2, wherein the second portion of the feed line includes a Y-shape opening towards the antenna.

4. The device of claim 1, wherein the antenna is a Laser Direct Structuring (LDS) antenna including successive layers of conductive material formed on the housing.

5. The device of claim 1, wherein the antenna is a spiral antenna.

6. The device of claim 5, wherein the second portion of the feed line includes a Y-shape opening towards the antenna.

7. The device of claim 1, wherein the antenna, dielectric material , and feed line form a metal-insulator-metal (MIM) capacitor configured to help match an impedance of the antenna to an impedance of the feed line.

8. The device of claim 1, wherein the coupling between the antenna and the feed line is a proximity coupling.

9. A method of forming a non-contact antenna feed for a hearing assistance device, the method comprising:

forming a hearing aid housing, the housing having a selected dielectric constant;

forming an antenna on an exterior side of the housing;

forming a feed line on the housing, a first portion of the feed line deposited on an interior side of the housing and a second portion of the feed line is deposited on the exterior side of the housing, and the second portion of the feed line is in proximity with the antenna so as to be separated from and electromagnetically coupled with the antenna.

10. The method of claim 9, wherein forming the feed line includes depositing the feed line using Laser Direct Structuring (LDS).

11. The method of claim 9, wherein the antenna is a spiral antenna.

12. The method of claim 9, wherein the antenna is a solid loop antenna.

13. The method of claim 9, wherein forming the antenna and depositing the feed line include situating the antenna and feed line to be separated by a dielectric material so as to form a metal-insulator-metal (MIM) capacitor using the feed line, antenna, and the dielectric material, the MIM capacitor to help match an impedance of the feed line to an impedance of the antenna.

* * * * *